US007175128B2

(12) United States Patent
Korthäuer

(10) Patent No.: US 7,175,128 B2
(45) Date of Patent: Feb. 13, 2007

(54) DEVICE FOR ACCOMMODATING A SUPPLY ROLL AROUND WHICH WEB STRIPS ARE WOUND, PARTICULARLY A LABEL SUPPY ROLL

(75) Inventor: Manfred Korthäuer, Mülheim/Ruhr (DE)

(73) Assignee: Espera-Werke GmbH, Duisburg (DE)

( * ) Notice: Subject to any disclaimer, the term of this patent is extended or adjusted under 35 U.S.C. 154(b) by 0 days.

(21) Appl. No.: 10/398,350

(22) PCT Filed: Apr. 25, 2002

(86) PCT No.: PCT/EP02/04563

§ 371 (c)(1),
(2), (4) Date: Apr. 4, 2003

(87) PCT Pub. No.: WO02/092482

PCT Pub. Date: Nov. 21, 2002

(65) Prior Publication Data

US 2004/0011915 A1 Jan. 22, 2004

(30) Foreign Application Priority Data

May 17, 2001 (DE) ..... 101 25 761

(51) Int. Cl.
*B65H 75/24* (2006.01)

(52) U.S. Cl. ..... 242/571; 242/573.1; 242/573.9

(58) Field of Classification Search ..... 242/571, 242/573.1, 573, 573.9
See application file for complete search history.

(56) References Cited

U.S. PATENT DOCUMENTS 4,141,517 A 2/1979 Olcer
4,148,444 A * 4/1979 Hehner ..... 242/571.3
4,149,682 A * 4/1979 Gustafson et al. ..... 242/571.3
5,011,094 A * 4/1991 Azuma ..... 242/573.1
5,170,960 A * 12/1992 Pretto ..... 242/573
5,318,236 A 6/1994 Morello et al.
5,775,631 A 7/1998 Murakami
5,863,011 A * 1/1999 Narita et al. ..... 242/573
6,299,099 B1 * 10/2001 Miller et al. ..... 242/529
6,328,249 B1 * 12/2001 Ogawa et al. ..... 242/559.2

FOREIGN PATENT DOCUMENTS

| | | |
|---|---|---|
| AT | 381918 | 3/1979 |
| CA | 1095484 | 2/1981 |
| CH | 431568 | 6/1965 |
| DE | 3109157 | 7/1982 |

(Continued)

*Primary Examiner*—William A. Rivera
*Assistant Examiner*—Sang Kim
(74) *Attorney, Agent, or Firm*—Collard & Roe, P.C.

(57) ABSTRACT

A device for mounting a delivery spool (3) having a wound band strip, in particular a labeling delivery spool, is described, which has a mandrel-like mounting core (15), a holding device, by means of which the delivery spool is releasably arrestable and/or is releasably clamped on the mounting core, and a device for axial alignment of the delivery spool. In order to make possible the attachment as well as the adjustment of a delivery spool in a comfortable manner, it is provided that the holding device that secures the delivery spool and the device for axial alignment of the delivery spool can be actuated through a common drive (30, 16). The actuation preferably takes place automatically.

12 Claims, 3 Drawing Sheets

FOREIGN PATENT DOCUMENTS

| | | | |
|---|---|---|---|
| DE | 19507892 | | 9/1996 |
| DE | 19642910 | | 4/1997 |
| DE | 101 09 882 | | 8/2002 |
| GB | 2071535 | | 9/1981 |
| JP | 62140958 A | * | 6/1987 |

* cited by examiner

DEVICE FOR ACCOMMODATING A SUPPLY ROLL AROUND WHICH WEB STRIPS ARE WOUND, PARTICULARLY A LABEL SUPPY ROLL

CROSS REFERENCE TO RELATED APPLICATIONS

Applicant claims priority under 35 U.S.C. §119 of German Application No. 101 25 761.9, filed May 17, 2001. Applicant also claims priority under 35 U.S.C. §365 of PCT/EP02/04563, filed Apr. 25, 2002. The International application under PCT article 21(2) was not published in English.

BACKGROUND OF THE INVENTION

1. Field of the Invention

The present invention relates to a device for mounting a delivery spool having a wound band strip, in particular a label delivery spool, with a mounting core, a holding device, by means of which the delivery spool is releasably arrestable and/or releasably clamped on the mounting core, and a device for axial adjustment of the delivery spool. In particular, the invention relates to a device for printing of a band strip or of labels adhered to a band strip, in which the band strip is unwound from a delivery roll and is supplied to a printing mechanism, whereby the delivery spool is held by a mounting device of the above-described type.

2. The Prior Art

Such a mounting device is described in the previously unpublished German patent application 101 09 882.0 originating from the Applicant.

Printers, such as those typically used in the area of price signs, include among other things a mounting device for the delivery spool, which is a band strip with or without labels, a printing mechanism, and a paper winding device, as well as components for use of thermo-transfer foils. In order to make the insertion of the respective spool most simple, the printing mechanism is typically provided with an opening mechanism. The state of the art is that the printing mechanism is opened by operation of an actor, in order to install or replace the spool with or without labels. For loading the spool, it is placed on an associated mounting device and there, likewise secured. A determined initial length of the band strip forming the spool is lead through the printing mechanism, and likewise secured on a winding device. The winding device can contain a mechanism, which simplifies the removal of the band strip. Before the printing process can start, the printing mechanism must be closed.

SUMMARY OF THE INVENTION

An object of the present invention is to produce a device of the above-described type, in which the attachment as well as the alignment of a delivery spool is possible in a comfortable manner.

This object is achieved through a device with the features of the invention. Preferred and advantageous embodiments of the invention are provided in the invention.

The invention essentially comprises in that the holding device that fixes the delivery spool and the device for axial alignment of the delivery spool are operable through a common drive.

With the inventive device, therefore, a band strip wound on a delivery spool can be secured and aligned simply and comfortably.

Preferably the holding device and the device for axial alignment are automatically operated.

A signal, which causes the automatic operation of the holding device and the device for axial alignment of the delivery spool, can be produced in various ways. According to one advantageous embodiment, it is provided that this signal is produced by means of a measuring device, which detects the mounting of a new delivery spool on the mandrel-like mounting core and/or the placement or threading of a band strip beginning into a guide associated with the band strip. This measuring device can comprise a switch, a scanning element, a magnetic sensor and/or a light barrier.

According to a further advantageous embodiment, the signal, which causes the automatic operation of the holding device and the device for axial alignment of the delivery spool, also can be produced by means of a sensor, switch, or scanning element associated with a winding device.

A further preferred embodiment of the device according to the invention comprises that at least the mounting core is formed to be interchangeable. This construction makes possible the use of various mounting cores with different outer diameters, so that according to the core diameter of the respective delivery spool, a mounting core adapted thereto can be used.

BRIEF DESCRIPTION OF THE DRAWINGS

Next, the invention will be described with reference to several embodiments shown in the drawings. The drawings show.

DETAILED DESCRIPTION OF PREFERRED EMBODIMENTS

Figure 1:
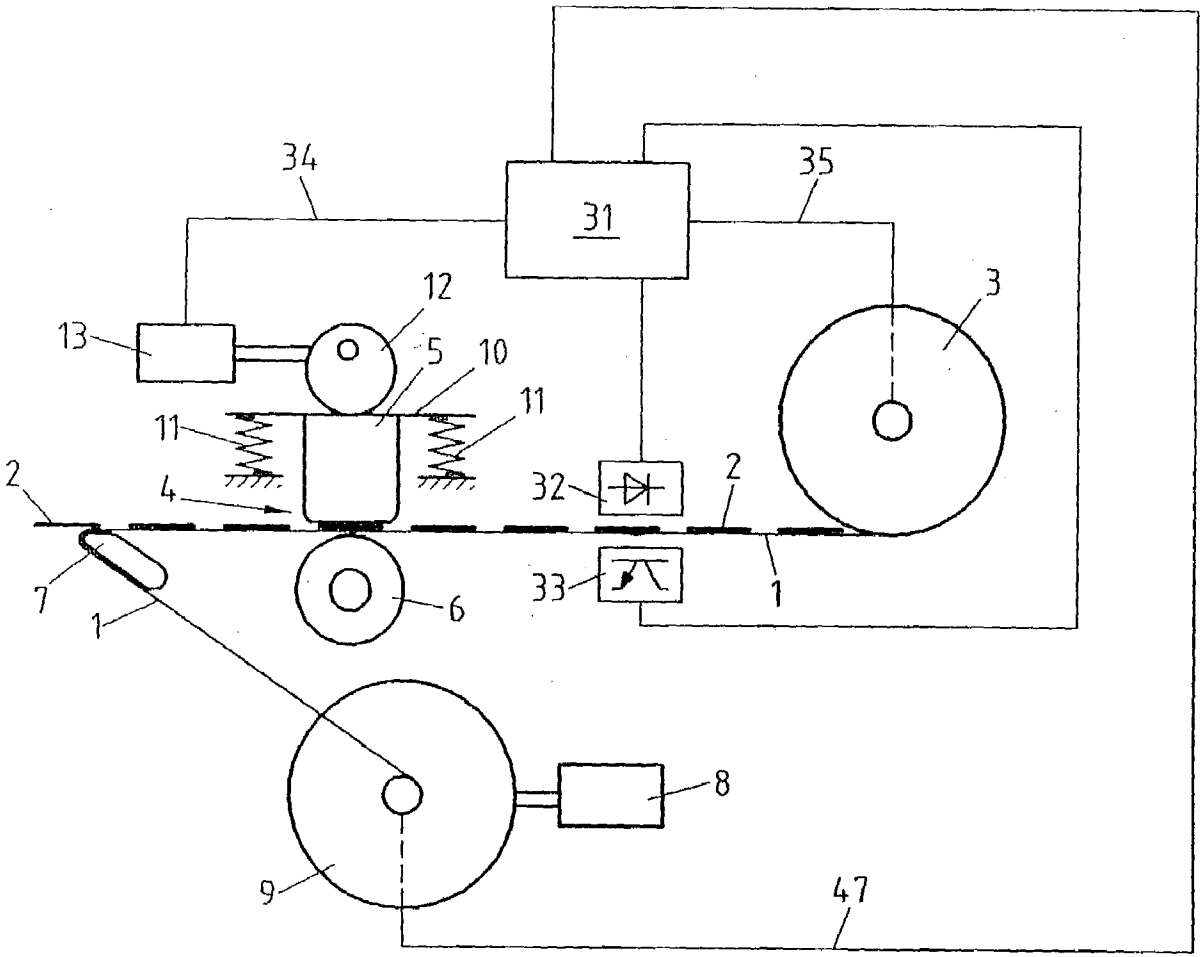
FIG. 1 a schematic illustration of a device for printing of a band strip.
Figure 3:
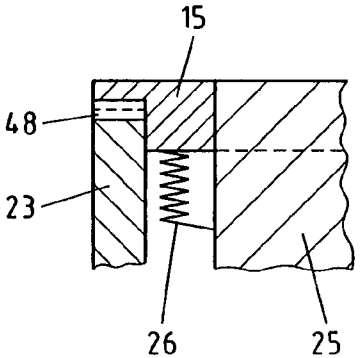
FIG. 3 an enlarged representation of a section of FIG. 2.

In FIG. 1, a printer for printing labels 2 adhered on a carrier band strip is illustrated. The band strip 1 is unwound from a delivery spool 3 and supplied to a printing mechanism 4. The printing mechanism 4 is made up of a printing head 5 and a printing roller 6. The printing head 5 presses the labels with a sufficient force against the printing roller 6 and prints them, for example, in a thermo- or in a thermo-transfer method. Alternatively, it is also possible to movably mount the printing roller 6 such that it can be moved towards the printing head 5 and away from the latter and presses, in its position adjusted to the printing head 5, the labels 2 against the printing head 5 with sufficient force. The printing roller 6 can be driven by means of step motor (not shown). In the strip running behind the printing mechanisms, a relative sharp deflection in the form of a dispensing edge 7 is provided, on which the printing labels are released in a known manner from the carrier band strip 1 and can be taken through an opening in the housing of the printer and attached to an object to mark or designate. Instead of the dispensing edge 7, also a deflection spool with a small diameter can be used. The carrier band strip 1 is unwound after the deflection on the dispensing edge 7 from a winding device 9 driven by a step motor 8.

The printing head 5 of the printing mechanism 4 is attached to a moveably mounted plate 10, on which spiral springs 11 supported on fixed bearings engage on sides of the printing head 5. On the other side of the plate 10 rests an eccentrically mounted circular disk 12, which is rotatably by a step motor 13. Based on the spring action, the printing head 5 upon rotation of the eccentrically mounted circular disk 12 is moved away from the printing roller 6, so that the printing head 5 takes in a sufficiently large distance relative to the printing roller 6, in order to be able to move easily the band strip 1 with the labels 2 adhered thereon through the printing mechanism 4.

Figure 2:
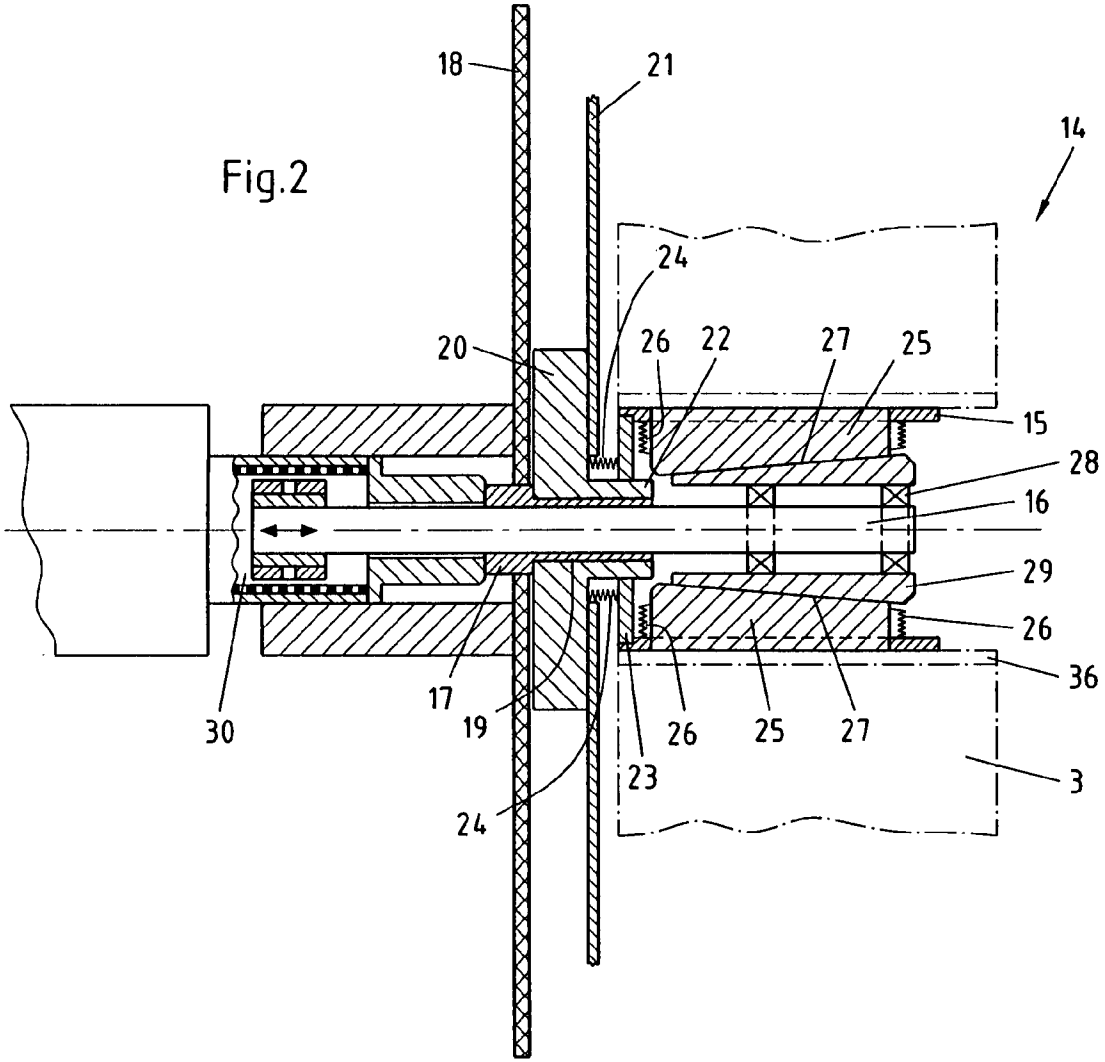
FIG. 2 a schematic sectional illustration of a mounting device for mounting a delivery spool.

The delivery spool 3 is slipped on a mounting device 14, which has a mandrel-like mounting core, a holding device, by means of which the delivery spool 3 is releasably held and/or releasably clamped on the mounting core, and device for axial alignment of the delivery spool 3. A possible embodiment of the mounting device is schematically illustrated in FIG. 2.

The delivery spool 3 is designated partially in dotted lines. It is slipped on a mandrel-like mounting core 15, which is rotatably mounted on an axially moveable actuating axis 16. The actuating axis 16 is supported in a sleeve-shaped friction bearing 17, which is non-rotatably held in a recess of a base plate 18. The sleeve-shaped friction bearing 17 has a diameter-reduced section 19, on which a support 20 in the form of a rotationally symmetric body is rotatably mounted. The rotationally symmetric support 20 is arranged with axial play in respect to the base plate 18. The support 20 is further provided with a ring-shaped contact disk 21, which serves for axially guiding or alignment of the delivery spool 3.

The support 20 has a sleeve-shaped section 22, on which a stop element 23 is axially-adjustably mounted, the stop element being non-rotatably but axially-releasably connected with the mounting core 15. The stop element 23 is embodied in the illustrated embodiment in a ring-shaped disk and is non-rotatably connected with the mounting core 15 by an feather key 48. The stop element 23 and the mounting core 15 fixedly connected therewith are supported on the rotatably supported support 20 by means of elastic springs 24.

Several openings are formed in the mounting core 15, the openings being uniformly distributed around the periphery of the mounting core 15, in which, respectively, at least one radially displaceable holding element 25 is inserted, each of which is elastically biased by means of coil springs 26 to the interior of the mounting core 15. The holding elements 25 have oblique inner sides 27, which rest on a conical sleeve 29 that is rotatably mounted on the actuating axis 16 by means of roller bearings 28.

The mounting core 15, including elements 25 placed therein as well as the coil springs 26 connected therewith, can be exchange with another mounting core with a smaller or larger outer diameter. In the mounting core 15, the holding elements 25 are secured by a corresponding profiling against falling out.

The mounting core 15 can be retracted together with the holding elements 25 supported therein and the springs 26 from the conical sleeve 29. In doing so, the holding elements are pressed outwardly radially over the conical sleeve 29 against the spring force of the spring 26.

The remounting takes place in the reverse manner, since the holding elements 25 have an insertion bevel or slant. Upon remounting, it is merely to be taken care that the feather key 48 of the stop element 23 is engaged again in the mounting core 15.

The axially moveable actuating axis 16 is part of a common drive of the holding device that secures the delivery spool 3 on the mounting core 15 as well as the device for axial alignment of the delivery spool 3 in its specified position. In the illustrated embodiment, a schematically represented linear drive 30 is provided for axial displacement of the actuating axis 16. Instead of this type of linear drive, also other suitable drives can be used. For example, the actuating axis 16 can be provided with a gear rack section, in which a gear driven by an electric motor engages. Alternatively, it is also possible to provide the actuating axis 16 with a screw-thread section, or spiral-threaded section, which engages a fixedly arranged, rotatably mounted inner- and outer-toothed gear, which is in engagement on its outer toothing with a gear driven by an electric motor. A further advantageous possibility is that on an end of the actuating axis 16, a spindle nut is attached, which engages a spindle directly attached to a motor shaft.

The holding device, by means of which the delivery spool 3 is releasably clamped on the mounting core 15, and the device for axial alignment of the delivery spool 3 in its specified position are operated automatically as a function of a signal. The signal, which causes the automatic operation of the holding device as well as the device for axial alignment of the delivery spool 3, is produced in the illustrated embodiment by means of a measurement and control device 31 that detects the beginning of the band strip 1 (compare FIG. 1). The measurement and control device 31, in this connection, has a light barrier, which includes a light-emitting sender diode 32 and a receiver diode 33 associated therewith. If the beginning of the carrier band strip 1 passes the region of the light barrier, the receiver diode 33 no longer captures the light emitted from the sender diode 32, whereby a control signal is provided in the measurement and control device 31, which is lead to the step motor 13 associated with the eccentrically mounted circular disk 12 as well as to the common drive of the holding device and the device for axial adjustment of the delivery spool 3 via signal lines 34, 35.

This control signal causes the drive that is connected with the actuating axis 16 to be axially displaced, so that the conical sleeve 29 rotatably mounted thereon is shifted in the direction of the fixed base plate 18 at a small amount of millimeters. In this manner, first the holding elements 25 on the conical sleeve. 29 are shifted radially outward, so that the delivery spool 3 is clamped on the mounting core 15. As soon as the delivery spool 3 opposes the displacement of the holding elements 25 with a known resistance, the delivery spool 3 is drawn with forward-carrying axial displacement of the actuating axis 16 in the direction of the base plate 18 in its specified position and thereby, axially aligned. The displacement of the actuating axis 16 is then terminated. This can take place by means of the contact disk 21 and/or interruption switches (not shown) associated with the stop element 23, which cause a current cutoff. Alternatively, the displacement of the actuating axis can be terminated in an advantageous manner also by means of a time control.

In addition, with the measurement and control device 31, also the end of the band strip 1 wound on the delivery spool 3 is detected. If the end of the carrier band strip 1 passes the region of the light barrier, the receiver diode 33 captures the light emitted from the sender diode 32, whereby in the measurement and control device 31, a control signal is produced, which via the signal lines 34, 35 is lead to the step motor 13 and the holding device as well as the device for axial adjustment of the delivery spool 3. This control signal causes the printing head 5 to be opened and the actuating axis 16 with the conical sleeve 29 is shifted away at a determined amount from the base plate 18. Based on the operation of the operation of the springs 24, 26, the mounting core 15 is axially shifted relative to the contact disk 21 and the holding elements 25 arranged in the mounting core 15 move radially inward, so that the empty spool core 36 of the deliver spool 3 is no longer braced with the mounting core 15 and therefore, can be taken off of this without a problem.

Alternatively, the automatic operation of the holding device and the device for axial alignment of the delivery spool 3 can take place also in the following manner. After the full delivery spool 3 is arranged on the mounting core 15, the band strip 1 is moved through the opened printing mechanism 4 and subsequently is threaded in the winding device 9. Then, a mechanism (not shown) for a simple release of the later wound band strip 1 is reset in its initial position, whereby in the end position, a sensor associated with the winding device 9 is operated. The signal of the sensor causes the full delivery roll 3 to automatically tension and axially aligned. Next, the printing mechanism 4 likewise is automatically closed and subsequently, the band strip 1 is transported up to the point where the first label 2 is in the print position.

In order to avoid that labels 2 are pre-spent with this transport process, it is recommendable to previously removed the labels from the band strip 1 along the length from the printing head 5 to the winding device 9. A marking on the printing mechanisms 4, or the printer housing, makes this clear to the operator.

Figure 4:
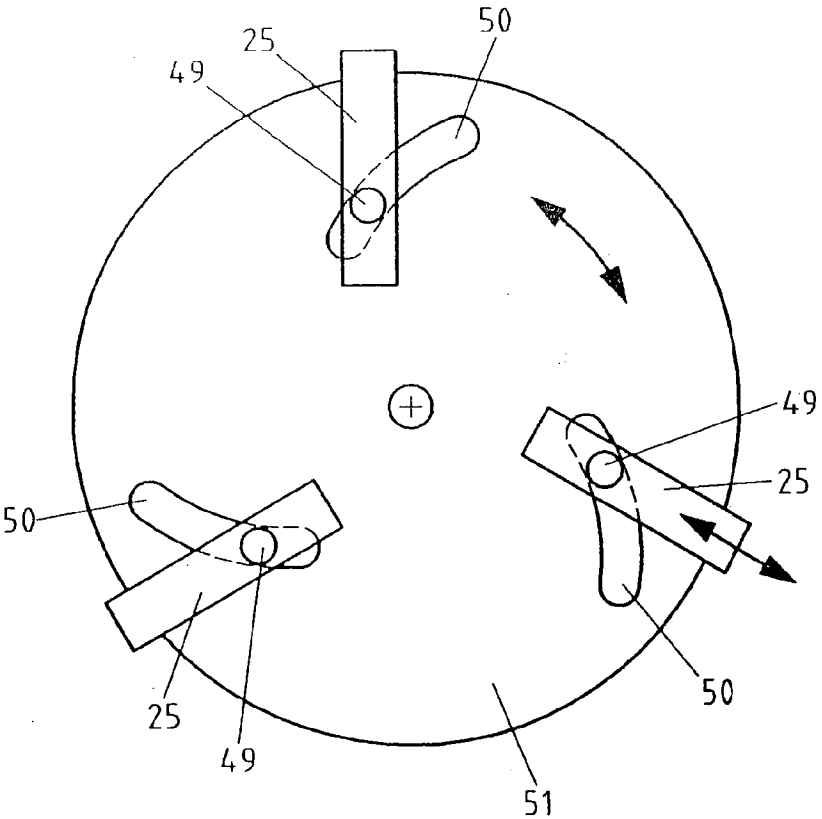
FIG. 4 a schematic representation of a second embodiment of a holding device according to the present invention.

The invention is not limited in its construction to the previously described embodiments. In addition, other different variations are contemplated, which are to be included in the inventive idea of the claims. So, for example, the holding elements 25 also can be formed differently and can be moved radially outwardly by other means than a conical sleeve. In FIG. 4, one embodiment is shown, in which several holding elements 25 are provided, respectively, with a pin 49 or rod, whereby the pin 49 or rod engages in curved grooves 50 or openings, which are formed to be essentially uniformly distributed in a spiral manner in a rotatably mounted circular disk 51. The holding elements 25 respectively are associated with radial guides (not shown). By rotation of the circular disk 51, the holding elements 25 are moved radially outward, or with a reverse rotation, radially inward.

Figure 6:
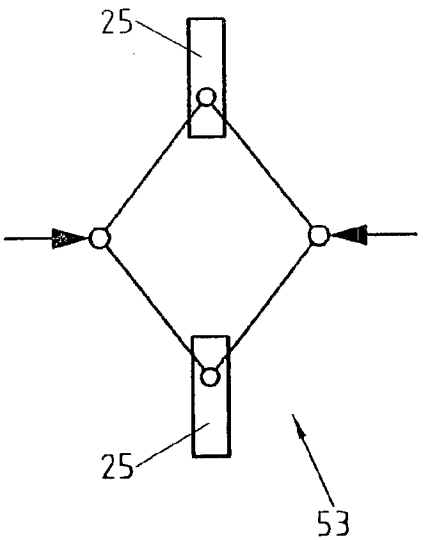
FIG. 6 a schematic representation of a fourth embodiment of the holding device of the present invention.
Figure 5:
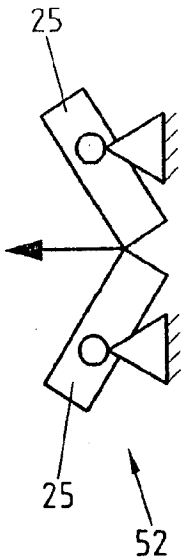
FIG. 5 a schematic representation of a third embodiment of a holding device according to the present invention.

Alternatively, it is also possible that the holding elements 25 are formed according to type of toggle or elbow lever 52 (FIG. 5), or to attached them to two diametrically opposite joints or hinges of a pivoting joint 53 (FIG. 6), in order to tension them with a spool mounted on the mounting core.

The features provided in the specification and in the patent claims, as well as visible in the drawings, can be essential to the realization of the present invention both singly or in various combinations.

REFERENCE NUMBER LIST

| | |
|---|---|
| 1 | band strip |
| 2 | labels |
| 3 | delivery spool |

-continued

REFERENCE NUMBER LIST

| | |
|---|---|
| 4 | printing mechanism |
| 5 | printing head |
| 6 | printing roller |
| 7 | deflecting edge |
| 8 | step motor |
| 9 | winding device |
| 10 | plate |
| 11 | coil springs |
| 12 | circular disk |
| 13 | step motor |
| 14 | mounting device |
| 15 | mounting core |
| 16 | actuating axis |
| 17 | friction bearing |
| 18 | base plate |
| 19 | friction bearing section |
| 20 | support |
| 21 | contact disk |
| 22 | sleeve-shaped section |
| 23 | stop element |
| 24 | coil spring |
| 25 | holding element |
| 26 | coil spring |
| 27 | oblique holding element side |
| 28 | roller bearing |
| 29 | conical sleeve |
| 30 | linear drive |
| 31 | measuring and control device |
| 32 | sender diode |
| 33 | receiving diode |
| 34 | signal line |
| 35 | signal line |
| 36 | spool core |
| 47 | signal line |
| 48 | feather key |
| 49 | pin |
| 50 | groove |
| 51 | circular disk |
| 52 | elbow lever |
| 53 | scissor-like joint |

The invention claimed is:

1. A device for mounting a delivery spool having a wound band, in particular a label delivery spool, comprising a mounting core (15), a base plate (18), a holding device having a holding element (25), by means of which the delivery spool (3) is releasably arrestable or is releasably clampable on the mounting core (15), and a device for axial alignment of the delivery spool (3), wherein said device for axial alignment of the delivery spool comprises an axial moveable actuating axis (16), on which the mounting core (15) is rotatably mounted by means of a bearing (28) arranged between the axial moveable actuating axis (16) and a conically formed sleeve (29), wherein the holding device is provided with a common motor-driven drive (30) moving said axial moveable actuating axis (16), wherein the holding device is operated by axial displacement of the axial moveable actuating axis (16), and wherein the axial displacement causes radial displacement of the holding element (25) and axial displacement of holding element (25) toward the base plate (18).

2. The device according to claim 1, wherein the holding device has more than one holding elements (25) uniformly distributed over the circumference of the mounting core (15), wherein each of said holding elements (25) is inserted with clearance in an associated opening formed in the mounting core (15), and wherein each of said holding elements (25) is elastically biased toward the interior of the mounting core (15).

3. The device according to claim 2, wherein the holding elements (25) have oblique inner sides (27), which rest on the conically formed sleeve (29) rotatably mounted on the actuating axis (16).

4. The device according to claim 1, wherein the device for axial adjustment of the delivery spool (3) has a rotatably mounted support (20) that is coaxial to the mounting core (15), and wherein the mounting core (15) is supported on the support (20) by means of at least one elastic spring (24).

5. The device according to claim 4, wherein the support (20) is rotatably mounted on the actuating axis (16).

6. The device according to claim 4, wherein the support (20) has a sleeve-shaped section (22), on which a stop element (23) that is connected with the mounting core (15) is axially moveably mounted.

7. The device according to claim 4, wherein the support (20) is provided with a contact disk (21).

8. The device according to claim 4, wherein the support (20) is rotatably mounted on a sleeve-shaped friction bearing (17), which is non-rotatably held in a recess of the base plate (18).

9. The device according to claim 8, wherein the actuating axis (16) is axially moveable in the friction bearing (17).

10. The device according to claim 1, wherein the holding device and the device for axial alignment of the delivery spool (3) are automatically operated.

11. The device according to claim 10, further comprising a sensor for producing a signal, which causes the automatic operation of the holding device and the device for axial alignment of the delivery spool (3), wherein the sensor is associated with a winding device (9), a switch, or a transmitting element.

12. A device for printing on a band strip or a label (2) adhered to a band strip (1), in which the band strip (1) is unwound from a delivery spool (3) and is supplied to a printing mechanism (4), wherein the delivery spool (3) is held by a mounting device (14), wherein the mounting device (14) is formed according to claim 1.

* * * * *